US008251107B2

(12) United States Patent
Clüsserath et al.

(10) Patent No.: US 8,251,107 B2
(45) Date of Patent: Aug. 28, 2012

(54) FILLING SYSTEM FOR UNPRESSURIZED HOT FILLING OF BEVERAGE BOTTLES OR CONTAINERS IN A BOTTLE OR CONTAINER FILLING PLANT

(75) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 521 days.

(21) Appl. No.: 12/564,290

(22) Filed: Sep. 22, 2009

(65) Prior Publication Data

US 2010/0071803 A1 Mar. 25, 2010

Related U.S. Application Data

(63) Continuation-in-part of application No. PCT/EP2008/001906, filed on Mar. 11, 2008.

(30) Foreign Application Priority Data

Mar. 23, 2007 (DE) ..... 10 2007 014 701

(51) Int. Cl.
*B65B 31/00* (2006.01)

(52) U.S. Cl. ..... 141/59; 141/7; 141/147; 141/301

(58) Field of Classification Search ..... 141/4–8, 141/82, 59, 144–147, 301, 302
See application file for complete search history.

(56) References Cited

U.S. PATENT DOCUMENTS

| | | | | |
|---|---|---|---|---|
| 7,469,726 | B2 * | 12/2008 | Clusserath et al. | 141/57 |
| 2005/0188654 | A1 | 9/2005 | Clusserath et al. | |
| 2005/0241726 | A1 | 11/2005 | Clusserath et al. | |

FOREIGN PATENT DOCUMENTS

| | | | |
|---|---|---|---|
| DE | 201 05 716 | U1 | 5/2002 |
| DE | 10 2004 004 331 | B3 | 9/2005 |
| EP | 0 775 668 | A1 | 5/1997 |
| EP | 1 584 601 | A | 10/2005 |

OTHER PUBLICATIONS

International Search Report PCT/EP2008/001906 and English translation thereof.

* cited by examiner

*Primary Examiner* — Gregory Huson
*Assistant Examiner* — Jason K Niesz
(74) *Attorney, Agent, or Firm* — Nils H. Ljungman & Associates

(57) ABSTRACT

A bottle or container filling system for unpressurized hot filling of beverage bottles or containers in a bottle or container filling plant. The bottle or container filling system comprises an unpressurized hot liquid reservoir, at least one filling element, and a controller.

20 Claims, 5 Drawing Sheets

FILLING SYSTEM FOR UNPRESSURIZED HOT FILLING OF BEVERAGE BOTTLES OR CONTAINERS IN A BOTTLE OR CONTAINER FILLING PLANT

CONTINUING APPLICATION DATA

This application is a Continuation-In-Part application of International Patent Application No. PCT/2008/001906, filed on Mar. 11, 2008, which claims priority from Federal Republic of Germany Patent Application No. 10 2007 014 701.7, filed on Mar. 23, 2007. International Patent Application No. PCT/2008/001906 was pending as of the filing date of this application. The United States was an elected state in International Patent Application No. PCT/2008/001906.

This application is also a Continuation-In-Part application of International Patent Application No. PCT/EP2008/002013, filed on Mar. 13, 2008, which claims priority from Federal Republic of Germany Patent Application No. 10 2007 014 702.5, filed on Mar. 23, 2007. International Patent Application No. PCT/EP2008/002013 was pending as of the filing date of this application. The United States was an elected state in International Patent Application No. PCT/EP2008/002013.

BACKGROUND

1. Technical Field

The present application relates to a filling system for unpressurized hot filling of beverage bottles or containers in a bottle or container filling plant, which filling system comprises at least one filler element with a product chamber or liquid channel, which is formed in a filler element housing, is connected to a heated reservoir for the liquid product and forms a liquid product dispenser, by way of which the liquid product flows into the respective container to be filled, a liquid valve that is positioned at the liquid channel, a return gas channel which during the filling process is connected to the interior space of the container that is arranged in a sealing position against the filler element, and a first flow path, which is realized in the filler element housing, is connected to the return gas channel and is switchable for slow filling into a throttled state in a manner controlled by valves to discharge the gas or air quantity displaced by the liquid product out of the interior space of said container during the filling of a container.

2. Background Information

Background information is for informational purposes only and does not necessarily admit that subsequently mentioned information and publications are prior art.

Filling systems are known, also such filling systems for the unpressurized filling of bottles or similar containers with a cold or hot liquid product, i.e. for cold filling or hot filling. In one possible embodiment, it is also known with such filling systems where the container to be filled in each case abuts in a sealing position against the filler element, to reduce the filling speed during the filling process in a manner controlled by valves, i.e. a slow filling process by means of throttling the return gas path for the gas or air quantity displaced out of the container during filling.

OBJECT OR OBJECTS

It is an object of the present application to provide a filling system, which comprises a simplified structure.

SUMMARY

This object may be achieved by a filling system for an unpressurized filling of a liquid product in bottles or similar containers. The filling system comprises at least one filler element with a product chamber or liquid channel, which is formed in a filler element housing, is connected to a heated reservoir for the liquid product and forms a liquid product dispenser, by way of which the liquid product flows into the respective container to be filled, a liquid valve that is positioned at the liquid channel, a return gas channel which during the filling process is connected to the interior space of the container that is arranged in a sealing position against the filler element, and a first flow path, which is realized in the filler element housing, is connected to the return gas channel and is switchable for slow filling into a throttled state in a manner controlled by valves to discharge the gas or air quantity displaced by the liquid product out of the interior space of said container during the filling of a container. The first flow path has a single control valve, which is provided in at least one first channel section of the first flow path that is connected to the return gas channel for the controlled opening and closing of said channel section, and in that the first flow path has at least one additional throttled channel section that bridges the control valve.

The filling system according to the present application, which is intended for unpressurized cold filling or hot filling, may comprise one single control valve per filler element that is necessary and/or desired for switching between high-speed filling and slow filling.

In another possible embodiment, the filling system for hot filling is also realized such that the heating of the filler elements, for example, in filling intervals or interruptions in the filling process is effected by the hot liquid product that flows through the filler elements with the liquid valves closed, in one possible embodiment flowing through a cycle (hot cycle). To this end, a second flow path is realized in each filler element, said second flow path in one possible embodiment being part of a product cycle that includes the heated reservoir or another reservoir for the liquid product with a heating or heating up system. This liquid product flow or hot cycle that heats the filler elements is introduced by activating at least one control valve, which, for example, is provided in the second flow path of each filler element or in one possible embodiment is provided in a line that is common to the filler elements of the filling machine or to a group of several filler elements, is connected to the second flow path and is also part of the liquid product cycle that heats the filler elements.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Further developments and application possibilities of the present application are produced from the following description of possible embodiments and from the Figures. In this case, the described and/or graphically represented features, individually or in arbitrary combination, are, in principle, an object of the present application. The present application is described below by way of the Figures of possible embodiments, in which, in detail.

DESCRIPTION OF EMBODIMENT OR EMBODIMENTS

Figure 1:
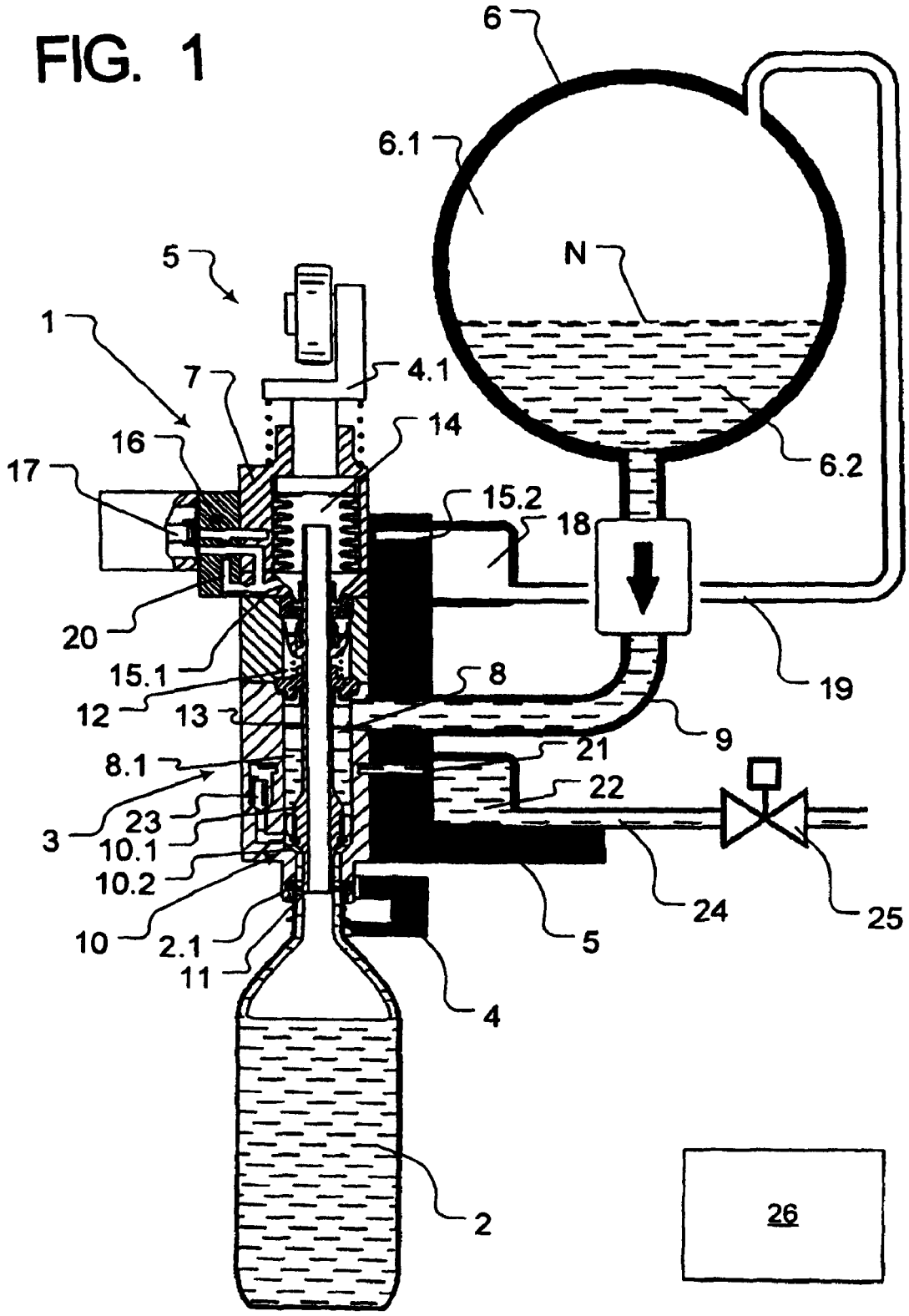
FIG. 1 shows a simplified representation of a filling system according to the present application, together with a bottle raised to the filler element of said system.
Figure 2:
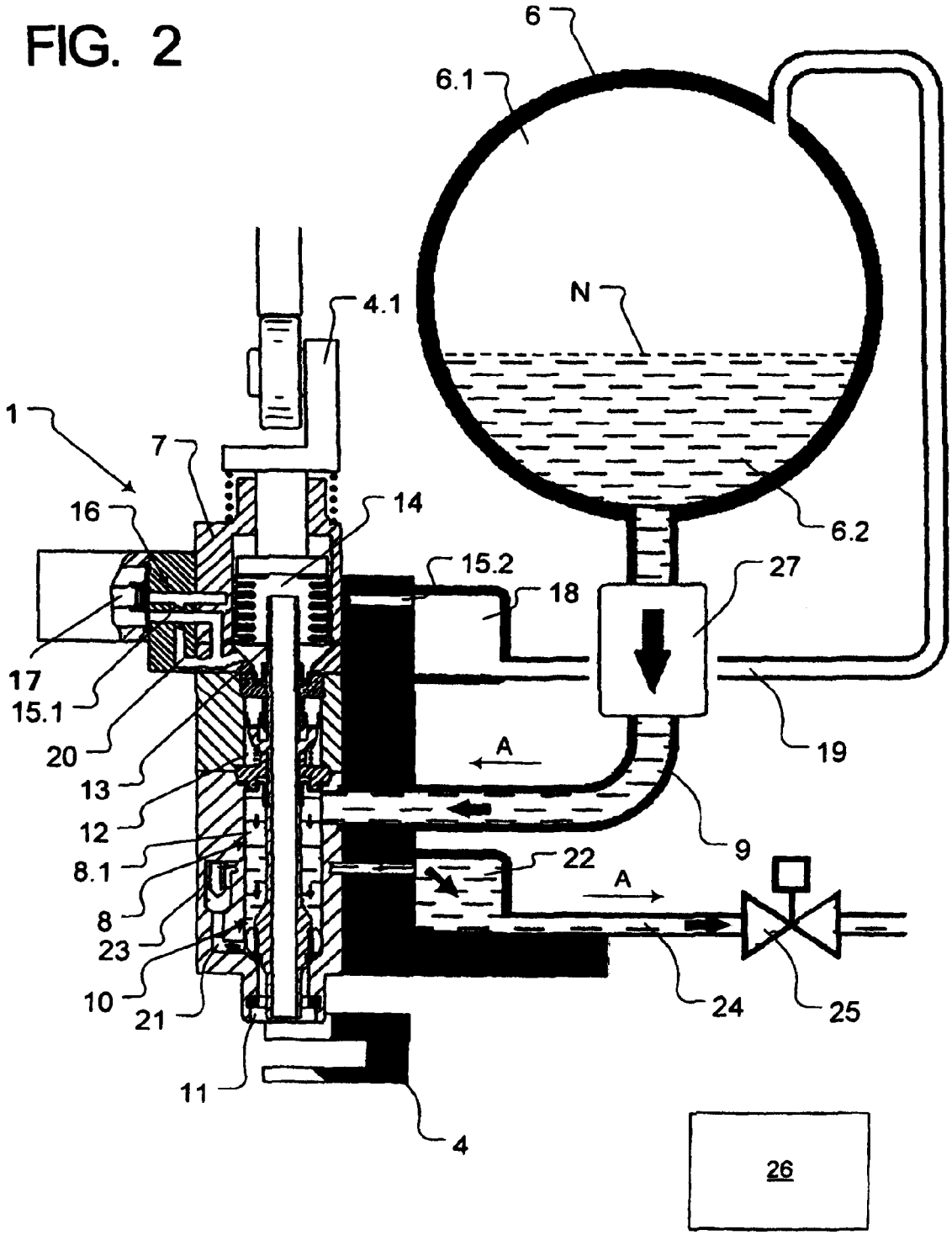
FIG. 2 shows the filling system in FIG. 1 in an operating state, where the hot filling process has been interrupted.

The filling system, identified in general in FIGS. 1 and 2 by the reference 1, is a component of a filling machine of the rotary type for filling a liquid product into bottles 2 or similar containers. For this purpose, the filling system 1 comprises essentially a filler element 3 and a bottle or container support 4 that is associated with said filler element, said bottle or container support in the specific embodiment represented serving to hold the bottles 2 at a mouth flange 2.2 that is formed below the bottle mouth 2.1 and, to this end, for example, being realized in the shape of a fork. The filler element 3 and the associated container support 4 are provided with a plurality of filler elements 2 and container supports 4 of a similar type on the periphery of a rotor 5 of the filling machine, said rotor being driveable in a rotating manner about a vertical machine axis. A heated reservoir, vessel, or tank 6 that is common to the filler elements is situated above the filler elements 3 at the rotor 5, said heated reservoir being filled in a level controlling manner during the filling process up to a predetermined level N. A gas space 6.1 and a liquid space 6.2 are consequently formed in the heated reservoir 6. The liquid product is supplied in a controlled manner to the heated reservoir 6 via a supply line (not represented).

A liquid channel 8 is provided in a housing 7 of the filler element 3, said liquid channel being connected to the liquid space 6.2 of the heated reservoir 6, for example in the form of an annular heated reservoir, by means of a line 9. The liquid valve 10 is provided in the liquid channel 8 for the controlled dispensing of the liquid product via a dispensing opening 11, which is formed on the bottom side of the filler element by the end of the liquid channel 8 which is open at that location.

The liquid valve 10 comprises substantially a valve body 10.1, which is positioned in the liquid channel 8 and interacts with a valve seat 10.2. The valve body 10.1 is realized on a gas pipe 13, which is positioned on the same axis as the vertical filler element axis, is open at both ends and serves at the same time as valve plunger for actuating the liquid valve 10 and, to this end, interacts with an actuating device 12. The bottom open end of the gas pipe 13 is surrounded by the ring-shaped dispensing opening 11. The top open end of the gas pipe 13 opens out into a gas space 14 that is formed in the housing 7. The pressing of the respective bottle against the filler element 3 is effected, in the case of this possible embodiment, at least in a supporting manner, by the pressure prevailing in the gas space 14 and acting on the pressing linkage 4.1 of the respective container carrier.

The gas space 14 is connected to a channel section 15.1 that is formed in the housing 7, said channel section, together with an additional channel section 15.2 and a control valve 17 that is positioned between said channel sections, forms a controlled connection or a controlled flow path 16 between the gas space 14 and an annular channel 18, said flow path being provided at the rotor 5 jointly for the filler elements 3 of the filling machine and being connected by means of a line 19 to the gas space 6.1 of the heated reservoir 6. A throttled channel 20 is provided parallel or substantially parallel to the control valve 17 in the housing 7, by means of which throttled channel there is a constant or substantially constant, but throttled connection between the gas space 14 and the annular channel 18.

In addition, a channel 21 is formed in the housing 7 of the filler element 3, said channel connecting the liquid channel 8 or the part section 8.1 of each filler element 3 to an annular channel 22, which, in its turn, is provided at the rotor 5 for the filler elements 3 of the filling machine together and which opens out into the liquid channel in the direction of flow upstream of the valve seat 10.2 of the liquid valve 10, in the vicinity of said valve seat. A non-return valve 23 is provided in the channel 21, said non-return valve opening for a direction of flow out of the liquid channel 8 into the annular channel, but staying closed for a flow in the opposite direction. A line 24 with an electrically controllable valve or solenoid valve 25 leads to the annular channel 22.

The actuating device 12 and also the control valve 17 or its actuating device are each pneumatically actuated and are controlled by means (not shown) of electrically controllable valves (solenoid valves). In the case of a filling machine with a plurality of filler elements 3, the actuating elements 12 and also the control valves 17 of the individual filler elements 3 are controlled individually by a central control unit 26. The liquid valve 10 and the control valve 17 are closed in the initial state. In the following description of the various process or method steps also, the aforementioned valves are each in their closed state unless the open state is expressly specified.

The most varied filling methods are possible with the filling system 1, for example:

- unpressurized cold filling, for example of juices or other still beverages and
- unpressurized hot filling, for example of juices or other still beverages of still beverages.

The method steps for cold and hot filling are:

With the control valve 17 initially closed, the bottle 2 is introduced and raised against the filler element 3 so that the bottle mouth 2.1 abuts sealingly against the dispensing opening 11 or against the seal at that location.

High-speed filling: The liquid valve 10 is opened for the filling process via the actuating element 12 controlled by the control device 26. At the same time, the control valve 17 is also opened. The liquid product quantity flowing to the bottle is detected by the flow meter 27 that is positioned in the line 9. The air or gas quantity displaced by the liquid product out of the bottle 2 flows via the channel 15.1, the open control valve 17 and partially also via the throttled channel 20 and the channel 15.2 into the annular channel 18.

Decelerating filling: The control valve 17 is closed by the control device 26 controlled by the measuring signal that is supplied by the flow meter 27, such that the air or gas displaced by the liquid product out of the bottle 2 can flow via the throttled channel 20 and the channel 15.2 into the annular channel 22 and consequently a decelerating filling process at reduced filling speed is effected (liquid product quantity flowing to the bottle per unit time).

End of filling: The liquid valve 10 is closed via the control device 26, brought about by the signal supplied by the flow meter 27 as soon as the necessary and/or desired liquid product quantity has been admitted into the bottle 2.

Following this, the filled bottle 2 is lowered with the container support 4 and said bottle is pushed out at the container outlet of the filling machine.

The filling method described above is basically identical for both unpressurized cold filling (filling the liquid product in the cold state or at ambient temperature) and for unpressurized hot filling (hot liquid product, in one possible embodiment also at a temperature that prevents, restricts, and/or minimizes contamination by germs).

To maintain the temperature of the filler elements 3 during the hot filling process during an interruption in the filling process, with liquid valves 10 closed, hot liquid product is supplied from the heated reservoir 6 via the line 9 to the filler elements 3 of a filling machine, and with valve 25 open, to the individual filler elements, said liquid product flowing through the section 8.1 of the liquid channel 8 of each filler element 3 and also the channel section 21 with the non-return valve 23 open and is supplied back to the heated reservoir 6 via the annular channel 22 and the line 24. This circuit of the hot liquid product through the filler elements 3 is automatically started, for example, if there is an interruption in the filling process and after the filler elements 3 or their liquid valves have been closed, in one possible embodiment, however, before resumption of the filling process that was interrupted by closing the valves 25. The annular channel 22 remains filled with the liquid product.

During the hot filling process, the non-return valve prevents, restricts, and/or minimizes liquid product out of the annular channel 22 that is filled with said liquid product and out of other filler elements 3 that are connected to said channel during the filling process flowing into the respective bottle 2 via each of the open liquid valves 10 and thereby adulterating the volumetric filling of the bottles 2 that is controlled by the flow meter 27.

For unpressurized cold filling, the non-return valve 23 is locked in the closed position by means of suitable measures, for example by means of impingement of the annular channel 22 with the pressure of a sterile pressure medium, for example with sterile air or a sterile liquid, so that the non-return valve 23 consequently blocks the connection between the liquid channel 8 and the annular channel 22.

The distinctive feature of the afore-described filling system is consequently that for unpressurized filling, in one possible embodiment also for unpressurized hot filling, just one single control valve 17 is necessary and/or desired for maintaining the temperature of the filler elements 3 at each filler element, thereby producing, therefore, one possible embodiment for the filler elements 3 of a filling machine that performs in a reliable manner.

The present application has been described above by way of possible embodiments. It is obvious that modifications and variations are possible without departing from the teaching concept underlying the present application.

Filling system for unpressurized filling of a liquid product in bottles or similar containers, said filling system having at least one filler element with a product chamber or liquid channel formed in a filler element housing, said product chamber or liquid channel being connected to a heated reservoir for the liquid product and forming a liquid product dispenser, by way of which the liquid product flows into the respective container to be filled.

Figure 3:
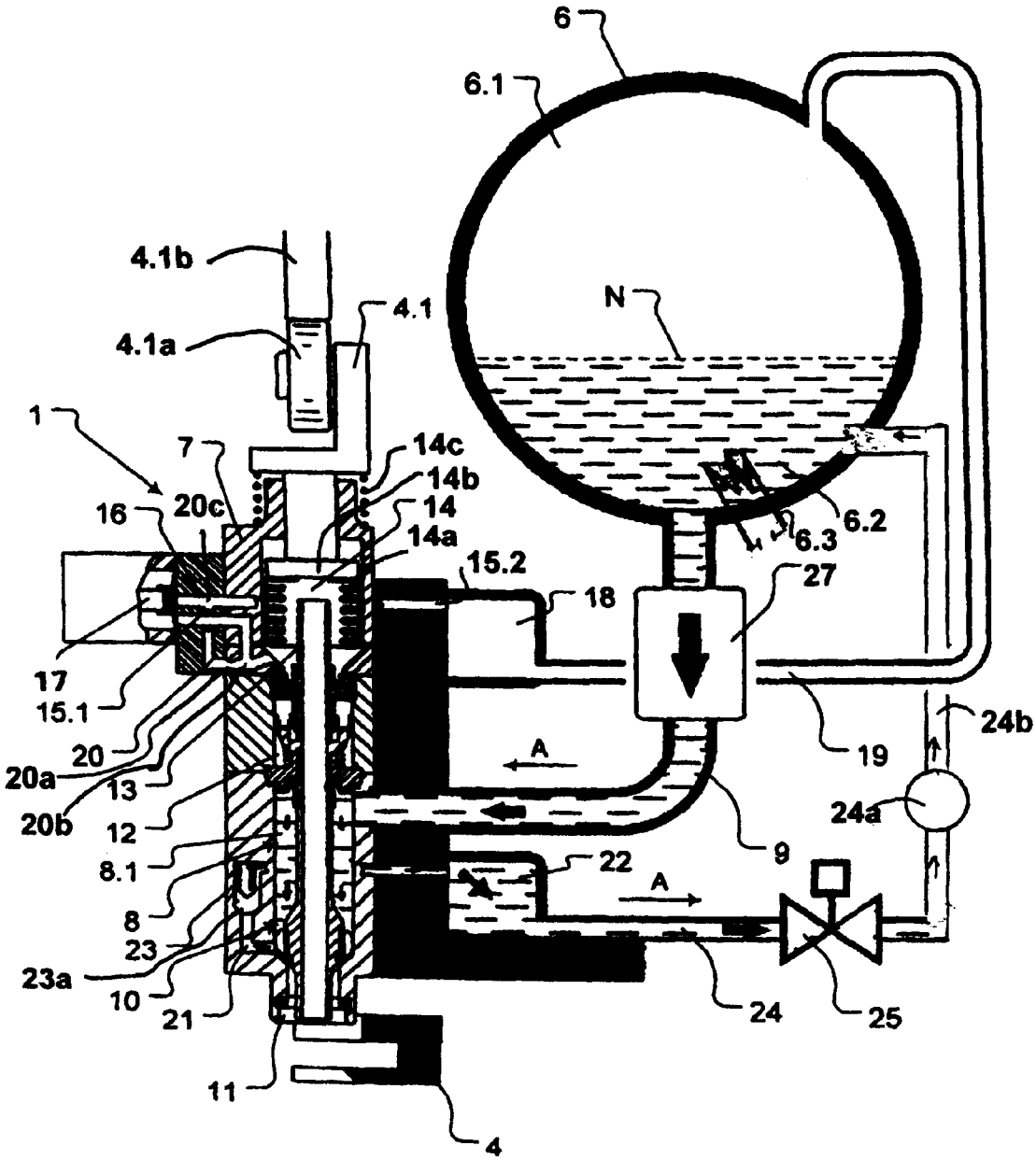
FIG. 3 is a detail showing a filling element cooperatively connected to a filling system.
Figure 4:
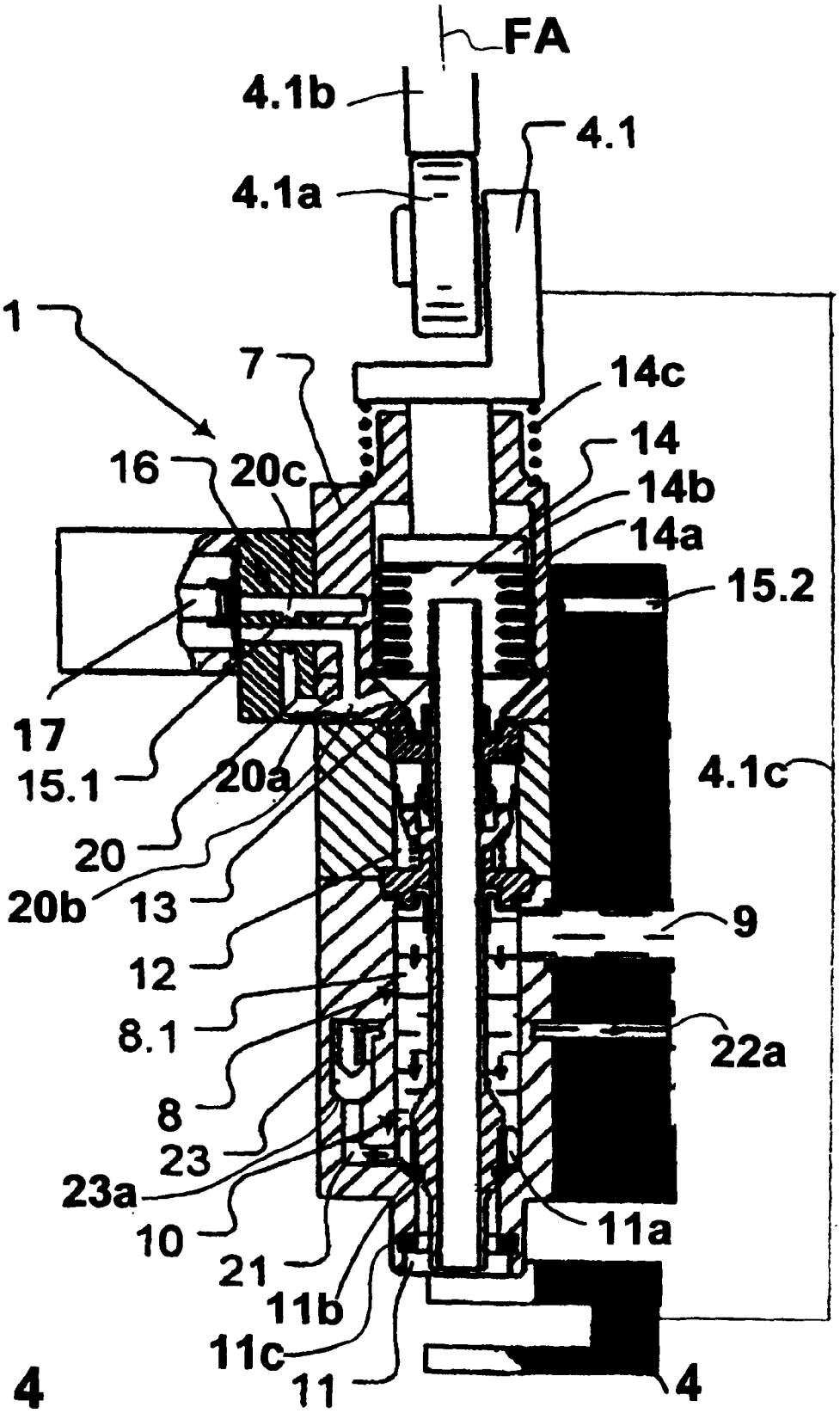
FIG. 4 is a detail showing a filling element in an operating state, where the filling process has been interrupted.

FIGS. 3 and 4 show detail of at least embodiment of a filling element 1. A bottle or container filling system is configured to unpressurizedly fill bottles or other container 2 with a hot liquid. The filling system comprises an unpressurized hot liquid reservoir 6 configured and disposed to hold a supply of hot liquid 6.2 and a gas in a head space 6.1 above the hot liquid. Filling element 1 comprises housing 7. A dispensing opening 11 is disposed on the bottom of housing 7. Dispensing opening 11 is configured and disposed to permit the dispensing of hot liquid therethrough and into a bottle 2 to be filled. A liquid flow arrangement 8 is disposed and configured to permit the flow of hot liquid from unpressurized hot liquid reservoir 6 to dispensing opening 11. A flow meter 27 is disposed and configured to measure the flow of hot liquid flowing from unpressurized hot liquid reservoir 6 to its corresponding filling element. A return gas flow arrangement 13 is configured and disposed to receive a flow of displaced gas from a bottle 2 being filled with hot liquid. Return gas flow arrangement 13 is operatively connected to a sole valve 17 configured to switch the gas flow rate to permit switching its corresponding filling element between a higher liquid filling rate, during initial filling of a bottle 2 with hot liquid, and a lower liquid filling rate, during final filling of a bottle 2. A first gas duct **20*b* is disposed in housing 7 and is operatively connected to return gas flow arrangement 13 and sole valve 17. A second gas duct 15.1 and 15.2 is disposed in housing 7 and is operatively connected to sole valve 17 and head space 6.1, in unpressurized hot liquid reservoir 6. A third gas duct 20 is disposed in housing 7 and is operatively connected to first gas duct 20*b* and second gas duct 15.1 and 15.2, at point 20*c*, bridging sole valve 17. A gas flow throttle 20*a* is operatively connected to third gas duct 20 and is configured and disposed to permit the flow of gas through third gas duct 20 at a lower filling rate. In the embodiment shown, throttle 20*a* is a narrowing of gas duct 20, however, other and different flow regulators or flow reducers as are known in the art may be used to regulate the flow of gas through gas duct 20**.

Sole valve 17, upon opening, is configured to permit gas flow therethrough, in parallel with gas flow through flow throttle **20*a*, and to permit displaced gas flow out of bottle 2 and into headspace 6.1 during the higher liquid filling rate, upon a bottle 2** being filled with liquid during the higher liquid filling rate, during initial filling.

Sole valve 17, upon closing, is configured to stop the flow of gas therethrough and still permit a flow of gas between first gas duct **20*b* and second gas duct 15.1, through third gas duct 20 and gas flow throttle 20*a***, during the lower liquid filling rate during final filling.

Filling element 1 comprises a temperature maintaining system configured to maintain a temperature of each filling element 1, in a plurality of filling elements 1, and hot liquid within each filling element 1, at a temperature substantially equal to a bottle filling temperature, by circulation of hot liquid from unpressurized hot liquid reservoir 6, upon the bottle filling system not filling bottles. The temperature maintaining system comprises a heater 6.3 configured to heat the hot liquid. Heater 6.3 is shown in reservoir 6, however, it is to be understood that heater 6.3 may be disposed anywhere within the liquid circulation of the hot liquid. The hot liquid circulation arrangement comprises a liquid duct 21 with an inlet operatively connected to the liquid flow arrangement 13, proximate dispensing opening 11. A weighted one way valve 23 is disposed in the hot liquid circulation arrangement and is configured to open, by being lifted from valve seat **23*a*, upon a predetermined pressure being reached in liquid flow arrangement 13. A shut off valve 25 is configured to stop the flow of hot liquid in the hot liquid circulation arrangement. A pump 24*a* is disposed and configured to move hot liquid through the hot liquid circulation arrangement from liquid flow arrangement 13 to unpressurized hot liquid reservoir 6, through liquid line 24***b*, having an outlet into unpressurized hot liquid reservoir 6.

The bottle filling system further comprises a controller 26 operatively connected to sole valve 17, flow meter 27, said shut off valve 25, and pump 24*a*. Controller 26 is configured to open sole valve 17 upon initiation of filling of a bottle 2 and to close sole valve 17 upon a predetermined initial amount of hot liquid passing through flow meter 27 to a bottle 2 being filled. Controller 26 is further configured to start pump 24*a* and move hot liquid through the hot liquid circulation arrangement, upon the stopping of filling of bottles 2 by the bottle filling system.

The bottle filling system may comprise a plurality of filling elements 1, each being substantially equidistantly disposed about a perimeter of a rotor 5. The bottle filling system may also comprise a gas collecting chamber 18, operatively connected to the second gas duct 15.1 and 15.2 of each filling element 1 and configured to receive displaced gas, from bottles 2 being filled, and convey the displaced gas to head space 6.1 in unpressurized hot liquid reservoir 6.

The bottle filling system may further comprise a liquid collecting chamber 22, operatively connected to the hot liquid circulation arrangement of each filling element 1. Collecting chamber 22 is configured to receive hot circulated liquid from liquid flow arrangement 13 and convey the hot liquid to unpressurized hot liquid reservoir 6.

As shown in FIG. 4, the respective bottle 2 to be filled is held during the filling process on a container or bottle holder 4, which in the illustrated embodiment holds the respective bottle 2 by means of a radially projecting flange configured to hold bottle 2 on the bottle neck, below the bottle mouth. The bottle carrier can be moved by a predetermined distance along the axis FA to raise and lower the bottle 2, and in one possible embodiment to press the bottle 2 with the edge of its mouth against the gasket 11*c*, and in one possible embodiment controlled by a control roller 4.1*a* that is connected by means of a lifting rod 4.1*c* and interacts with a control cam 4.1*b* that may not rotate with rotor 5. By means of a compression spring 14*c* and by means of a pressure exerted on the piston 14*b*, in the chamber 14 comprising bellows 14*a*, the container carrier 4 is biased upward for the movement, so that for a filling there is a "self-clamping" effect.

Guide elements 11*a* may be provided for the liquid, generally these devices may be referred to as screens or shields. Guide elements 11*a* may be located on the external contour of the valve body 13 and may be configured to deflect the liquid and steer it toward the bottle 2 wall in a swirling motion. For example, guide elements 11*a* may be swirl inserts or torsion bodies and may be located inside the liquid path and impart a rotational motion to the liquid, as a result of which the liquid flows into bottle 2 in contact with the inside wall of the bottle 2 by centrifugal force. A swirl effect of the liquid may be realized with a swirler 11*a* in the form of a flat, plane element. In at least one possible embodiment, the liquid beverage is swirled into the bottles or containers 2 to cause the liquid to travel across at least a substantial portion of the interior surface of the bottles.

A seal 11*c* may be located proximate guide elements 11*a* to effectuate sealing of the neck about the opening of bottle 2 with filling element 1. A seal 11*b* may be disposed about an outer perimeter of liquid flow arrangement 13 for closing off the flow of liquid into a bottle 2 through dispensing opening 11.

In at least one embodiment, a filling element having a sole valve configured to switch between a high filling rate during initial filling and low filling rate during final filling, is provided. A filling machine may have more than a hundred filling elements on a rotor. Filling elements of the prior art typically have two or more valves for switching between filling rates, greatly increasing the number of parts of the filling machine. Therefore, costs in manufacturing a filling machine may be decreased with embodiments of the present disclosure. Additionally, it is well known in the art that downtime increases substantially with an increase in the number of parts. Therefore, embodiments of the present disclosure may provide filling machines with increased reliability and increased mean time between failure.

Figure 5:
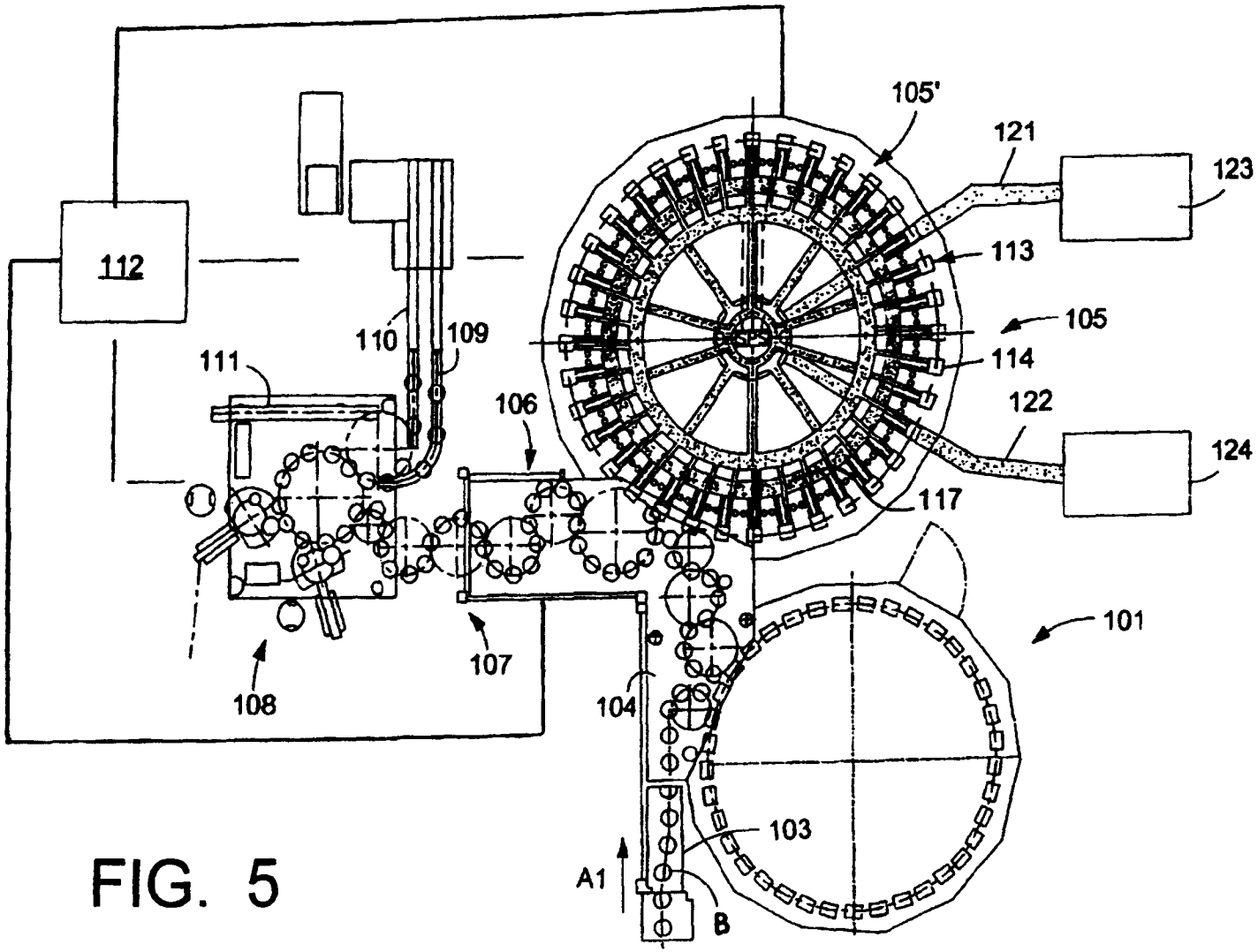
FIG. 5 shows schematically the main components of one possible embodiment example of a system for filling containers.

FIG. 5 shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 5 shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 5, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

One feature or aspect of an embodiment is believed at the time of the filing of this patent application to possibly reside broadly in a filling system for an unpressurized filling of a liquid product in bottles or similar containers 2, said filling system having at least one filler element 3 with a product chamber or liquid channel 8, which is formed in a filler element housing 7, is connected to a heated reservoir 6 for the liquid product and forms a liquid product dispenser 11, by way of which the liquid product flows into the respective container 2 to be filled, a liquid valve 10 that is positioned at the liquid channel 8, a return gas channel 13, 14 which during the filling process is connected to the interior space of the container 2 that is arranged in a sealing position against the filler element 3, and a first flow path 16, which is realized in the filler element housing 7, is connected to the return gas channel 13, 14 and is switchable for slow filling into a throttled state in a manner controlled by valves to discharge the gas or air quantity displaced by the liquid product out of the interior space of said container during the filling of a container 2, wherein the first flow path 16 has a single control valve 17, which is provided in at least one first channel section 15.1, 15.2 of the first flow path 16 that is connected to the return gas channel 13, 14 for the controlled opening and closing of said channel section, and in that the first flow path has at least one additional throttled channel section 20 that bridges the control valve 17.

Another feature or aspect of an embodiment is believed at the time of the filing of this patent application to possibly reside broadly in the filling system, wherein the first controlled flow path 16 is provided between the return gas channel 13, 14 and a first collecting chamber 18 that is common to a plurality of filler elements 3.

Yet another feature or aspect of an embodiment is believed at the time of the filing of this patent application to possibly reside broadly in the filling system, wherein in the heated reservoir 6 there is a liquid space 6.2 for the liquid product and located above said liquid space 6.2 a gas space 6.1, and in that the gas space 6.1 of the heated reservoir 6 is connected to the first flow path 16 or to the first collecting chamber 18.

Still another feature or aspect of an embodiment is believed at the time of the filing of this patent application to possibly reside broadly in the filling system, wherein the return gas channel is formed partially by a gas space 14 in the filler element housing 7, to which the first flow path is connected.

A further feature or aspect of an embodiment is believed at the time of the filing of this patent application to possibly reside broadly in the filler system, wherein by means of the at least one second throttled channel section 20, there is a constant or substantially constant connection between the return gas channel 13, 14 or the gas space 14 of said return gas channel and the gas space 6.1 of the heated reservoir or of the first collecting chamber 18.

Another feature or aspect of an embodiment is believed at the time of the filing of this patent application to possibly reside broadly in the filling system, wherein the return gas channel is formed by a return gas pipe 13 which is open at both ends and extends into the interior space of the container 2 to be filled with its bottom end and into the gas space 14 with its top end.

Yet another feature or aspect of an embodiment is believed at the time of the filing of this patent application to possibly reside broadly in the filling system, wherein a second flow path 21 is realized in the filler element housing 7 for heating or keeping hot the respective filler element 3 during a hot filling process, said second flow path, with reference to the flow direction of the liquid product in the liquid channel 8, connecting to a part section 8.1 of the liquid channel 8 located upstream of the liquid valve 10, and in that at least one control valve 25 is provided for controlling the flow of a hot liquid product from the heated reservoir 6 through the part section 8.1 and the second flow path 21.

Still another feature or aspect of an embodiment is believed at the time of the filing of this patent application to possibly reside broadly in the filling system, wherein the second flow path connects the part section 8.1 of the liquid channel 8 of the respective filler element 3 to a second collecting chamber 22 that is common to a plurality of filler elements 3.

A further feature or aspect of an embodiment is believed at the time of the filing of this patent application to possibly reside broadly in the filling system, wherein the at least one second control valve 25 is provided in the second flow path 21.

Another feature or aspect of an embodiment is believed at the time of the filing of this patent application to possibly reside broadly in the filling system, wherein the at least one second control valve 25 is provided in a connection for discharging the hot liquid product out of the second flow path 21, for example in a line 24 connected to the second collecting chamber 22 for discharging, for example for returning the liquid product to the heated reservoir 6.

Yet another feature or aspect of an embodiment is believed at the time of the filing of this patent application to possibly reside broadly in the filling system, wherein in a filling machine with a plurality of filler elements 3, the second control valve 25 is either provided jointly for the filler elements 3 of the filling machine or for a group of several filler elements 3.

Still another feature or aspect of an embodiment is believed at the time of the filing of this patent application to possibly reside broadly in the filling system, wherein a non-return valve 23 is provided in the second flow path 21, said non-return valve opening for a flow out of the liquid duct 8 of the filler element 3 and closing for a flow in the opposite direction.

A further feature or aspect of an embodiment is believed at the time of the filing of this patent application to possibly reside broadly in the filling system, wherein the second flow path 21 opens out into the liquid channel 8 in the direct vicinity of the liquid valve 10 or of a valve seat 10.2 of the liquid valve 10.

One feature or aspect of an embodiment is believed at the time of the filing of this patent application to possibly reside broadly in the filling system, wherein the first and/or second collecting chamber 18, 22 are provided on the rotor.

Another feature or aspect of an embodiment is believed at the time of the filing of this patent application to possibly reside broadly in a bottle filling system configured to unpressurizedly fill bottles with a hot liquid, said bottle filling system comprising: an unpressurized hot liquid reservoir configured and disposed to hold a supply of hot liquid and a gas in a head space above the hot liquid; at least one filling element, each said at least one filling element comprising: a housing; a dispensing opening disposed on the bottom of said housing; said dispensing opening being configured and disposed to permit the dispensing of hot liquid therethrough and into a bottle to be filled; a liquid flow arrangement being disposed and configured to permit the flow of hot liquid from said unpressurized hot liquid reservoir to said dispensing opening; a flow meter being disposed and configured to measure the flow of hot liquid flowing from said unpressurized hot liquid reservoir to its corresponding filling element; a return gas flow arrangement being configured and disposed to receive a flow of displaced gas from a bottle being filled with hot liquid, said return gas flow arrangement comprising: a sole valve configured to switch its gas flow rate to permit switching its corresponding filling element between a higher liquid filling rate, during initial filling of a bottle with hot liquid, and a lower liquid filling rate, during final filling of a bottle; a first gas duct disposed in said housing and being operatively connected to said return gas flow arrangement and said sole valve; a second gas duct disposed in said housing and being operatively connected to said sole valve and said head space in said unpressurized hot liquid reservoir; a third gas duct disposed in said housing and being operatively connected to said first gas duct and said second gas duct, bridging said sole valve; a gas flow throttle operatively connected to said third gas duct, said gas flow throttle being configured and disposed to permit the flow of gas through said third gas duct; said sole valve, upon opening, being configured to permit gas flow therethrough, in parallel with gas flow through said flow throttle, and to permit displaced gas flow out of a bottle and into said headspace during the higher liquid filling rate, upon a bottle being filled with liquid during the higher liquid filling rate, during initial filling; said sole valve, upon closing, being configured to stop the flow of gas therethrough and still permit a flow of gas between said first gas duct and said second gas duct, through said third gas duct and said gas flow throttle, during the lower liquid filling rate during final filling; each said at least one filling element further comprising: a temperature maintaining system configured to maintain a temperature of each said at least one filling element and hot liquid within said at least one filling element at a temperature substantially equal to a bottle filling temperature by circulation of hot liquid from said unpressurized hot liquid reservoir, upon said bottle filling system not filling bottles; said temperature maintaining system comprising: a hot liquid circulation arrangement comprising an inlet operatively connected to said liquid flow arrangement, proximate said dispensing opening; a weighted one way valve in said hot liquid circulation arrangement configured to open upon a predetermined pressure being reached in said liquid flow arrangement; a shut off valve configured to stop the flow of hot liquid in said hot liquid circulation arrangement; a pump configured to move hot liquid through said hot liquid circulation arrangement from said liquid flow arrangement to said unpressurized hot liquid reservoir; and said hot liquid circulation arrangement comprising an outlet into said unpressurized hot liquid reservoir; said bottle filling system further comprising a controller operatively connected to said sole valve, said flow meter, said shut off valve, and said pump; said controller being configured to open said sole valve upon initiation of filling of a bottle and to close said sole valve upon a predetermined initial amount of hot liquid passing through said flow meter to a bottle being filled; said controller further being configured to start said pump and move hot liquid through said hot liquid circulation arrangement, upon the stopping of filling of bottles by said bottle filling system.

Yet another feature or aspect of an embodiment is believed at the time of the filing of this patent application to possibly reside broadly in a bottle filling system, wherein said at least one filling element comprises a plurality of filling elements, each said plurality of filling elements being substantially equidistantly disposed about a perimeter of a rotor, said bottle filling system further comprising a gas collecting chamber, said gas collecting chamber being operatively connected to said second gas duct of each said plurality of filling elements and being configured to receive displaced gas, from bottles being filled, and convey the displaced gas to said head space in said unpressurized hot liquid reservoir.

Still another feature or aspect of an embodiment is believed at the time of the filing of this patent application to possibly reside broadly in a bottle filling system further comprising a liquid collecting chamber, said liquid collecting chamber being operatively connected to said hot liquid circulation arrangement of each said plurality of filling elements and being configured to receive hot circulated liquid from said liquid flow arrangement and convey the hot liquid to said unpressurized hot liquid reservoir.

A further feature or aspect of an embodiment is believed at the time of the filing of this patent application to possibly reside broadly in a bottle filling system, wherein said housing comprises a gas reservoir operatively connected to said return gas flow arrangement, said first valve duct, and a piston, said piston being operatively connected to a camming arrangement configured to increase the volume of said gas reservoir upon the sealing of a bottle about said dispensing opening.

Another feature or aspect of an embodiment is believed at the time of the filing of this patent application to possibly reside broadly in a container filling system configured to fill containers with a liquid, said container filling system comprising: an liquid reservoir configured and disposed to hold a supply of liquid and a gas in a head space above the liquid; at least one filling element, each said at least one filling element comprising: a dispensing opening; said dispensing opening being configured and disposed to permit the dispensing of liquid therethrough and into a container to be filled; a liquid flow arrangement being disposed and configured to permit the flow of liquid from said liquid reservoir to said dispensing opening; a flow meter being disposed and configured to measure the flow of liquid flowing from said liquid reservoir to its corresponding filling element; a return gas flow arrangement being configured and disposed to receive a flow of displaced gas from a container being filled with a liquid, said return gas flow arrangement comprising: a sole valve configured to switch its gas flow rate to permit switching its corresponding filling element between a higher liquid filling rate, during initial filling of a container, and a lower liquid filling rate, during final filling of a container; a first gas duct operatively connected to said return gas flow arrangement and said sole valve; a second gas duct operatively connected to said sole valve and said head space in said liquid reservoir; a third gas duct, operatively connected to said first gas duct and said second gas duct, bridging said sole valve; a gas flow throttle operatively connected to said third gas duct, said gas flow throttle being configured and disposed to permit the flow of gas through said third gas duct; said sole valve, upon opening, being configured to permit gas flow therethrough, in parallel with gas flow through said flow throttle, and to permit displaced gas flow out of a container and into said headspace during the higher liquid filling rate, upon a container being filled with liquid during the higher liquid filling rate, during initial filling; said sole valve, upon closing, being configured to stop the flow of gas therethrough and still permit a flow of gas between said first gas duct and said second gas duct, through said third gas duct and said gas flow throttle, during the lower liquid filling rate during final filling.

Yet another feature or aspect of an embodiment is believed at the time of the filing of this patent application to possibly reside broadly in a container filling system further comprising a temperature maintaining system configured to maintain a temperature of each said at least one filling element and liquid within said at least one filling element at a temperature substantially equal to a container filling temperature by circulation of a temperature controlled liquid from said liquid reservoir, upon said container filling system not filling containers; said temperature maintaining system comprising: a temperature controlling arrangement configured to control the temperature of the liquid; a liquid circulation arrangement comprising an inlet operatively connected to said liquid flow arrangement, proximate said dispensing opening; a liquid moving arrangement disposed and configured to move liquid through said liquid circulation arrangement from said liquid flow arrangement to said liquid reservoir; and said liquid circulation arrangement comprising an outlet into said liquid reservoir.

Still another feature or aspect of an embodiment is believed at the time of the filing of this patent application to possibly reside broadly in a container filling system wherein said temperature controlling arrangement comprises a heater operatively connected to the liquid in said liquid reservoir, said heater being disposed and configured to heat the liquid in said liquid reservoir.

A further feature or aspect of an embodiment is believed at the time of the filing of this patent application to possibly reside broadly in a container filling system wherein said liquid circulation arrangement comprises a pump disposed and configured to move liquid from said liquid flow arrangement to said liquid reservoir.

Another feature or aspect of an embodiment is believed at the time of the filing of this patent application to possibly reside broadly in a container filling system wherein said liquid circulation arrangement comprises at least one valve disposed and configured to control the movement of liquid from said liquid flow arrangement to said liquid reservoir.

Yet another feature or aspect of an embodiment is believed at the time of the filing of this patent application to possibly reside broadly in a container filling system wherein said liquid circulation arrangement comprises a one way valve disposed and configured to open for a flow of liquid out of said liquid flow arrangement and close for a liquid flow into said liquid flow arrangement.

One feature or aspect of an embodiment is believed at the time of the filing of this patent application to possibly reside broadly in a container filling system, wherein said at least one filling element comprises a plurality of filling elements, each said plurality of filling elements being substantially equidistantly disposed about a perimeter of a rotor, said container filling system further comprising a gas collecting chamber, said gas collecting chamber being operatively connected to said second gas duct of each said plurality of filling elements and being configured to receive displaced gas, from containers being filled, and convey the displaced gas to said head space in said liquid reservoir.

Another feature or aspect of an embodiment is believed at the time of the filing of this patent application to possibly reside broadly in a container filling system further comprising a liquid collecting chamber, said liquid collecting chamber being operatively connected to said liquid circulation arrangement of each said plurality of filling elements and being configured to receive circulated liquid from said liquid flow arrangement and convey the liquid to said liquid reservoir.

Yet another feature or aspect of an embodiment is believed at the time of the filing of this patent application to possibly reside broadly in a container filling system further comprising a gas reservoir operatively connected to said return gas flow arrangement and said first valve duct, said gas reservoir being disposed and configured to enhance the sealing of a container about said dispensing opening, prior to filling the container with liquid.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the German Office Action dated Apr. 6, 2009, and/or cited elsewhere are hereby incorporated by reference as if set forth in their entirety herein as follows: DE 201 05 716 U1, having the following German title "Gefässfüllmaschine," published on May 29, 2002.

All of the patents, patent applications or patent publications, which were cited in the International Search Report dated Jun. 20, 2008, and/or cited elsewhere are hereby incorporated by reference as if set forth in their entirety herein as follows: EP 0 775 668, having the following English translation of the German title "Filling machine and filling head for such a machine," published on May 28, 1997; and EP 1 584 601, having the following English translation of the German title "BEVERAGE BOTTLING PLANT FOR FILLING BOTTLES WITH A LIQUID BEVERAGE, HAVING A FILLING MACHINE WITH A ROTARY CONSTRUCTION FOR FILLING BOTTLES WITH A LIQUID BEVERAGE," published on Dec. 30, 2008.

All of the patents, patent applications or patent publications, which were cited in the International Search Report dated Nov. 27, 2008, of the US patent application Ser. No. 12/564,499, and/or cited elsewhere are hereby incorporated by reference as if set forth in their entirety herein as follows: DE 201 05 716, having the German title "Gefässfüllmaschine," published on May 29, 2002; EP 1 215 166, having the following English translation of the German title "Method and device for filling containers with a liquid product," published on Jun. 19, 2002; and EP 1 559 674, having the following English translation of the German title "Filler with circulation of the liquid," published on Aug. 3, 2005.

All of the patents, patent applications or patent publications, which were cited in the German Office Action dated Apr. 6, 2009, of the U.S. patent application Ser. No. 12/564,499, and/or cited elsewhere are hereby incorporated by reference as if set forth in their entirety herein as follows: DE 201 05 716 U1, having the following German title "Gefässfüllmaschine," published on May 29, 2002.

Some examples of methods for determining parameters such as the filling volume, the empty volume, and the filling height which may possibly be utilized or adapted for use in at least one possible embodiment may possibly be found in the following U.S. patents: U.S. Pat. No. 6,463,964, invented by Clüsserath, published on Oct. 15, 2002 and entitled "Method of operating a machine for filling bottles, cans or the like beverage containers with a beverage, and a beverage container filling machine"; U.S. Pat. No. 4,134,407, issued to Elam on Jan. 16, 1979 and entitled "External pressure-volume monitor"; U.S. Pat. No. 4,282,757 issued to Cohn on Aug. 11, 1981 and entitled "Device for detecting rate of change in pressure"; U.S. Pat. No. 4,391,412 issued to Goldhammer on Jul. 5, 1983 and entitled "Apparatus for limiting filling height of containers"; U.S. Pat. No. 4,765,342 issued to Urman et al. on Aug. 23, 1988 and entitled "Timed drift compensation for rate volume monitor"; U.S. Pat. No. 4,788,456 issued to Urman et al. on Nov. 29, 1988 and entitled "Variable threshold for rate volume monitor"; U.S. Pat. No. 4,928,687 issued to Lampotang et al. on May 29, 1990 and entitled "CO 2 diagnostic monitor"; U.S. Pat. No. 5,008,653 issued to Kidd et al. on Apr. 16, 1991 and entitled "Fluid detector with overfill probe"; U.S. Pat. No. 5,110,208 issued to Sreepada et al. on May 5, 1992 and entitled "Measurement of average density and relative volumes in a dispersed two-phase fluid"; U.S. Pat. No. 5,244,550 issued to Inoue on Sep. 14, 1993 and entitled "Two liquid separating methods and apparatuses for implementing them"; U.S. Pat. No. 5,279,157 issued to Mattis et al. on Jan. 18, 1994 and entitled "Liquid level monitor"; and U.S. Pat. No. 6,099,470 issued to Bahr on Aug. 8, 2000 and entitled "Monitor for diffusable chemical substance", all of these U.S. patents being hereby expressly incorporated by reference as if set forth in their entirety herein.

Some examples of flow meters that may possibly be utilized or possibly adapted for use in at least one possible embodiment of the present application may possibly be found in the following U.S. patent Publications: U.S. Pat. No. 7,139,667, entitled "Method for Calibrating a Volumetric Flow Meter Having an Array of Sensors"; U.S. Pat. No. 7,127,953, entitled "Target flow meters"; U.S. Pat. No. 6,845,704, "Beverage Making System with Flow Meter Measurement Control and Method"; U.S. Pat. No. 6,394,312, entitled "Beverage Feeding Apparatus"; U.S. Pat. No. 5,876,610, entitled "Method and Apparatus for Monitoring Liquid Flow Through an Enclosed Stream"; and U.S. Pat. No. 7,069,793, entitled "Ultrasonic Flow Meter and Ultrasonic Sensor".

Some examples of swirl-inducing devices that may possibly be utilized or adapted for use in at least one possible embodiment may possibly be found in the following U.S.

patents: U.S. Pat. Pub. No. 2005/0257499, entitled "Beverage bottling plant for filling bottles with a liquid beverage material having a filling machine", invented by Krulitsch, published on Nov. 24, 2005; U.S. Pat. No. 5,501,253, entitled "Apparatus for filling vessels with liquid;" U.S. Pat. No. 5,190,084, entitled "Filling element for filling machines for dispensing liquid;" and U.S. Pat. No. 4,757,847, entitled "Filling machine filling element having no filling tube."

Some examples of filling machines that may possibly be utilized or possibly adapted for use in at least one possible embodiment of the present application may possibly be found in the following filling machines: Innofill DVR, Innofill DNRV, Innofill NV, Innofill DVF, Innofill NMW, Innofill DRS, Innofill DPG, Innofill DNRT, and Innofill MF-UP; each being manufactured by KHS Maschinen-Und Anlagenbau AG, headquartered in Dortmund, Del.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; U.S. Pat. No. 5,301,488 issued to Ruhl et al. on Apr. 12, 1994; U.S. Pat. No. 7,469,726 issued to Clüsserath et al. on Dec. 30, 2008.

Some examples of control valve apparatus that may possibly be utilized or possibly adapted for use in at least one possible embodiment of the present application may possibly be found in the following U.S. patents: U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

Some examples of electric control valves that may possibly be utilized or possibly adapted for use in at least one possible embodiment of the present application may possibly be found in the following U.S. patents: U.S. Pat. No. 4,431,160 issued to Burt et al. on Feb. 14, 1984; and U.S. Pat. No. 4,609,176 issued to Powers on Sep. 2, 1986.

Some examples of hydraulic valves which may possibly be utilized or adapted for use in at least one possible embodiment may possibly be found in the following U.S. patents: U.S. Pat. No. 6,712,090, entitled "Hydraulic valve;" U.S. Pat. No. 6,745,557, entitled "Hydraulic valve arrangement;" U.S. Pat. No. 6,578,819, entitled "Hydraulic valve;" U.S. Pat. No. 6,505,645, entitled "Multiple hydraulic valve assembly with a monolithic block; U.S. Pat. No. 6,499,505, entitled "Hydraulic valve arrangement;" U.S. Pat. No. 6,427,721, entitled "Hydraulic valve arrangement with locking function;" U.S. Pat. No. 6,412,392, entitled "Hydraulic valve for a hydraulic consumer of a vehicle;" U.S. Pat. No. 6,397,891, entitled "Hydraulic valve, in particular, adjustable pressure control valve;" U.S. Pat. No. 6,349,743, entitled "High-pressure hydraulic valve;" and U.S. Pat. No. 6,305,418, entitled "Hydraulic valve."

Some examples of pneumatic arrangements that may possibly be utilized or possibly adapted for use in at least one possible embodiment of the present application may possibly be found in the following U.S. patents: U.S. Pat. No. 6,609,767 issued to Mortenson et al. on Aug. 26, 2003; U.S. Pat. No. 6,632,072 issued to Lipscomb et al. on Oct. 14, 2003; U.S. Pat. No. 6,637,838 issued to Watanabe on Oct. 28, 2003; U.S. Pat. No. 6,659,693 issued to Perkins et al. on Dec. 9, 2003; U.S. Pat. No. 6,668,848 issued to Ladler et al. on Dec. 30, 2003; and U.S. Pat. No. 6,676,229 issued to Marra et al. on Jan. 13, 2004.

Some examples of seal arrangements that may possibly be utilized or possibly adapted for use in at least one possible embodiment of the present application may possibly be found in the following U.S. patents: U.S. Pat. No. 5,411,273 issued to Pietsch et al. on May 2, 1995; U.S. Pat. No. 6,290,234 issued to Berle et al. on Sep. 18, 2001; U.S. Pat. No. 6,474,653 issued to Hintenlang et al. on Nov. 5, 2002; U.S. Pat. No. 6,616,146 issued to Friend et al. on Sep. 9, 2003; U.S. Pat. No. 6,692,007 issued to Oldenburg on Feb. 17, 2004; and U.S. Pat. No. 6,648,335 issued to Ezell on Nov. 18, 2003.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

Some examples of computer systems that may possibly be utilized or possibly adapted for use in at least one possible embodiment of the present application may possibly be found in the following U.S. patents: U.S. Pat. No. 5,416,480 issued to Roach et al. on May 16, 1995;U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

Some examples of bottling systems, which may be used or adapted for use in at least one possible embodiment of the present may be found in the following U.S. patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

Some examples of bottling and container handling systems and components thereof which may possibly be utilized or adapted for use in at least one possible embodiment, may possibly be found in the following U.S. patents: U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" U.S. Pat. No. 6,668,877, entitled "Filling System for Still Beverages;" U.S. Pat. No. 7,024,841, entitled "Labeling Machine with a Sleeve Mechanism for Preparing and Applying Cylindrical Labels onto Beverage Bottles and Other Beverage Containers in a Beverage Container Filling Plant;" U.S. Pat. No. 6,971,219 entitled "Beverage bottling plant for filling bottles with a liquid beverage filling material and a labelling station for labelling filled bottles and other containers;" U.S. Pat. No. 6,973,767, entitled "Beverage bottling plant and a conveyor arrangement for transporting packages;" U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations;" U.S. Pat. No. 7,108,025, entitled "Beverage Bottling Plant for Filling Bottles with a Liquid Beverage Filling Material, and a Container Filling Lifting Device for Pressing Containers to Container Filling Machines;" U.S. Pat. No. 7,062,894, entitled "Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" U.S. Pat. No. 7,010,900, entitled "Beverage Bottling Plant for Filling Bottles with a Liquid Beverage Filling Material, and a Cleaning Device for Cleaning Bottles in a Beverage Bottling Plant;" U.S. Pat. No. 6,918,417, entitled "A Beverage Bottling Plant for Filling Bottles with a Liquid Beverage Filling Material, and an Easily Cleaned Lifting Device in a Beverage Bottling Plant;" U.S. Pat. No. 7,065,938, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" U.S. Pat. No. 6,901,720, entitled "A Beverage Bottling Plant for Filling Bottles with a Liquid Beverage Filling Material, and Apparatus for Attaching Carrying Grips to Containers with Filled Bottles;" and U.S. Pat. No. 7,121,062 "Beverage bottling plant for filling bottles with a liquid beverage filling material, having a container handling machine with interchangeable receptacles for the container mouth."

U.S. patent application Ser. No. 12/564,499, entitled "FILLING SYSTEM FOR HOT FILLING OF BEVERAGE BOTTLES OR CONTAINERS IN A BOTTLE OR CONTAINER FILLING PLANT," having inventors Ludwig CLÜSSERATH and Dieter-Rudolf KRULITSCH, and filed on Sep. 22, 2009, is hereby incorporated by reference as if set forth in its entirety in.

The patents, patent applications, patent publications, and other publications listed herein are incorporated by reference in their entirety herein, except words relating to the opinions and judgments of the author and not directly relating to the technical details of the description of the embodiments therein are not incorporated by reference. The purpose of incorporating U.S. patents, Foreign patents, patent publications, and other publications is solely to provide additional information relating to technical features of one or more embodiments, which information may not be completely disclosed in the wording in the pages of this application. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not to be incorporated by reference herein.

The corresponding foreign and international patent publication applications, namely, Federal Republic of Germany Patent Application No. 10 2007 014 701.7, filed on Mar. 23, 2007, having inventors Ludwig CLÜSSERATH and Dieter-Rudolf KRULITSCH, and DE-OS 10 2007 014 701.7 and DE-PS 10 2007 014 701.7, and International Application No. PCT/EP2008/001906, filed on Mar. 11, 2008, having WIPO Publication No. WO 2008/116559 and inventors Ludwig CLÜSSERATH and Dieter-Rudolf KRULITSCH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The corresponding foreign and international patent publication applications of the U.S. patent application Ser. No. 12/564,499, namely, Federal Republic of Germany Patent Application No. 10 2007 014 702.5, filed on Mar. 23, 2007, having inventors Ludwig CLÜSSERATH and Dieter-Rudolf KRULITSCH, and DE-OS 10 2007 014 702.5 and DE-PS 10 2007 014 702.5, and International Application No. PCT/EP2008/002013, filed on Mar. 13, 2008, having WIPO Publication No. WO 2008/116564 and inventors Ludwig CLÜSSERATH and Dieter-Rudolf KRULITSCH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent application(s), that is, PCT/EP2008/001906, PCT/EP2008/002013, and German Patent Applications 10 2007 014 701.7 and 10 2007 014 702.5, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2008/001906, PCT/EP2008/002013, DE 10 2007 014 701.7, and DE 10 2007 014 702.5 from which this patent application claims priority which do not have to do with the correction of the translation in this patent application are not to be included in this patent application in the incorporation by reference.

Any statements about admissions of prior art in the original 1222 foreign patent applications PCT/EP2008/001906, PCT/EP2008/002013, DE 10 2007 014 701.7, and DE 10 2007 014 702.5 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

AT LEAST PARTIAL NOMENCLATURE

1, 1*a* Filling system
2 Bottle
2.1 Bottle mouth
2.2 Mouth flange
3, 3*a* Filler element
4 Container support
5 Rotor
6 Heated reservoir
7, 7*a* Housing
8 Liquid channel
9 Line
10.1 Valve body
10.2 Valve seat
11 Dispensing opening
12 Actuating device
13 Gas pipe
14 Gas space
15.1, 15.2 Channel
16 Flow path
17 Control valve
18 Annular channel
19 Line
20, 21 Channel
22 Annular channel
24 Line
25 Control valve
26 Control unit
27 Flow meter
A Direction of flow

What is claimed is:

1. A bottle filling system configured to unpressurizedly fill bottles with a hot liquid, said bottle filling system comprising:

an unpressurized hot liquid reservoir configured and disposed to hold a supply of hot liquid and a gas in a head space above the hot liquid;

at least one filling element, each said at least one filling element comprising:

a housing;

a dispensing opening disposed on the bottom of said housing;

said dispensing opening being configured and disposed to permit the dispensing of hot liquid therethrough and into a bottle to be filled;

a liquid flow arrangement being disposed and configured to permit the flow of hot liquid from said unpressurized hot liquid reservoir to said dispensing opening;

a flow meter being disposed and configured to measure the flow of hot liquid flowing from said unpressurized hot liquid reservoir to its corresponding filling element;

a return gas flow arrangement being configured and disposed to receive a flow of displaced gas from a bottle being filled with hot liquid, said return gas flow arrangement comprising:

a sole valve configured to switch its gas flow rate to permit switching its corresponding filling element between a higher liquid filling rate, during initial filling of a bottle with hot liquid, and a lower liquid filling rate, during final filling of a bottle;

a first gas duct disposed in said housing and being operatively connected to said return gas flow arrangement and said sole valve;

a second gas duct disposed in said housing and being operatively connected to said sole valve and said head space in said unpressurized hot liquid reservoir;

a third gas duct disposed in said housing and being operatively connected to said first gas duct and said second gas duct, bridging said sole valve;

a gas flow throttle operatively connected to said third gas duct, said gas flow throttle being configured and disposed to permit the flow of gas through said third gas duct;

said sole valve, upon opening, being configured to permit gas flow therethrough, in parallel with gas flow through said flow throttle, and to permit displaced gas flow out of a bottle and into said headspace during the higher liquid filling rate, upon a bottle being filled with liquid during the higher liquid filling rate, during initial filling;

said sole valve, upon closing, being configured to stop the flow of gas therethrough and still permit a flow of gas between said first gas duct and said second gas duct, through said third gas duct and said gas flow throttle, during the lower liquid filling rate during final filling, each said at least one filling element further comprising:

a temperature maintaining system configured to maintain a temperature of each said at least one filling element and hot liquid within said at least one filling element at a temperature substantially equal to a bottle filling temperature by circulation of hot liquid from said unpressurized hot liquid reservoir, upon said bottle filling system not filling bottles; said temperature maintaining system comprising:

a hot liquid circulation arrangement comprising an inlet operatively connected to said liquid flow arrangement, proximate said dispensing opening;

a weighted one way valve in said hot liquid circulation arrangement configured to open upon a predetermined pressure being reached in said liquid flow arrangement;

a shut off valve configured to stop the flow of hot liquid in said hot liquid circulation arrangement;

a pump configured to move hot liquid through said hot liquid circulation arrangement from said liquid flow arrangement to said unpressurized hot liquid reservoir; and said hot liquid circulation arrangement comprising an outlet into said unpressurized hot liquid reservoir;

said bottle filling system further comprising a controller operatively connected to said sole valve, said flow meter, said shut off valve, and said pump;

said controller being configured to open said sole valve upon initiation of filling of a bottle and to close said sole valve upon a predetermined initial amount of hot liquid passing through said flow meter to a bottle being filled;

said controller further being configured to start said pump and move hot liquid through said hot liquid circulation arrangement, upon the stopping of filling of bottles by said bottle filling system.

2. The bottle filling system according to claim 1, wherein said at least one filling element comprises a plurality of filling elements, each said plurality of filling elements being substantially equidistantly disposed about a perimeter of a rotor, said bottle filling system further comprising a gas collecting chamber, said gas collecting chamber being operatively connected to said second gas duct of each said plurality of filling elements and being configured to receive displaced gas, from bottles being filled, and convey the displaced gas to said head space in said unpressurized hot liquid reservoir.

3. The bottle filling system according to claim 2 further comprising a liquid collecting chamber, said liquid collecting chamber being operatively connected to said hot liquid circulation arrangement of each said plurality of filling elements and being configured to receive hot circulated liquid from said liquid flow arrangement and convey the hot liquid to said unpressurized hot liquid reservoir.

4. The bottle filling system according to claim 3, wherein said housing comprises a gas reservoir operatively connected to said return gas flow arrangement, said first valve duct, and a piston, said piston being operatively connected to a camming arrangement configured to increase the volume of said gas reservoir upon the sealing of a bottle about said dispensing opening.

5. A container filling system configured to fill containers with a liquid, said container filling system comprising:

an liquid reservoir configured and disposed to hold a supply of liquid and a gas in a head space above the liquid;

at least one filling element, each said at least one filling element comprising:

a dispensing opening;

said dispensing opening being configured and disposed to permit the dispensing of liquid therethrough and into a container to be filled;

a liquid flow arrangement being disposed and configured to permit the flow of liquid from said liquid reservoir to said dispensing opening;

a flow meter being disposed and configured to measure the flow of liquid flowing from said liquid reservoir to its corresponding filling element;

a return gas flow arrangement being configured and disposed to receive a flow of displaced gas from a container being filled with a liquid, said return gas flow arrangement comprising:

a sole valve configured to switch its gas flow rate to permit switching its corresponding filling element between a higher liquid filling rate, during initial filling of a container, and a lower liquid filling rate, during final filling of a container;

a first gas duct operatively connected to said return gas flow arrangement and said sole valve;

a second gas duct operatively connected to said sole valve and said head space in said liquid reservoir;

a third gas duct, operatively connected to said first gas duct and said second gas duct, bridging said sole valve;

a gas flow throttle operatively connected to said third gas duct, said gas flow throttle being configured and disposed to permit the flow of gas through said third gas duct;

said sole valve, upon opening, being configured to permit gas flow therethrough, in parallel with gas flow through said flow throttle, and to permit displaced gas flow out of a container and into said headspace during the higher liquid filling rate, upon a container being filled with liquid during the higher liquid filling rate, during initial filling;

said sole valve, upon closing, being configured to stop the flow of gas therethrough and still permit a flow of gas between said first gas duct and said second gas duct, through said third gas duct and said gas flow throttle, during the lower liquid filling rate during final filling.

6. The container filling system of claim 5 further comprising a temperature maintaining system configured to maintain a temperature of each said at least one filling element and liquid within said at least one filling element at a temperature substantially equal to a container filling temperature by circulation of a temperature controlled liquid from said liquid reservoir, upon said container filling system not filling containers; said temperature maintaining system comprising:

a temperature controlling arrangement configured to control the temperature of the liquid;

a liquid circulation arrangement comprising an inlet operatively connected to said liquid flow arrangement, proximate said dispensing opening;

a liquid moving arrangement disposed and configured to move liquid through said liquid circulation arrangement from said liquid flow arrangement to said liquid reservoir; and said liquid circulation arrangement comprising an outlet into said liquid reservoir.

7. The container filling system of claim 6 wherein said liquid circulation arrangement comprises a pump disposed and configured to move liquid from said liquid flow arrangement to said liquid reservoir.

8. The container filling system of claim 7 wherein said liquid circulation arrangement comprises at least one valve disposed and configured to control the movement of liquid from said liquid flow arrangement to said liquid reservoir.

9. The container filling system of claim 8 wherein said liquid circulation arrangement comprises a one way valve disposed and configured to open for a flow of liquid out of said liquid flow arrangement and close for a liquid flow into said liquid flow arrangement.

10. The container filling system according to claim 9, wherein said at least one filling element comprises a plurality of filling elements, each said plurality of filling elements being substantially equidistantly disposed about a perimeter of a rotor, said container filling system further comprising a gas collecting chamber, said gas collecting chamber being operatively connected to said second gas duct of each said plurality of filling elements and being configured to receive displaced gas, from containers being filled, and convey the displaced gas to said head space in said liquid reservoir.

11. The container filling system according to claim 10 further comprising a liquid collecting chamber, said liquid collecting chamber being operatively connected to said liquid circulation arrangement of each said plurality of filling elements and being configured to receive circulated liquid from said liquid flow arrangement and convey the liquid to said liquid reservoir.

12. The container filling system according to claim 11 further comprising a gas reservoir operatively connected to said return gas flow arrangement and said first valve duct, said gas reservoir being disposed and configured to enhance the sealing of a container about said dispensing opening, prior to filling the container with liquid.

13. The container filling system according to claim 12 wherein said temperature controlling arrangement comprises a heater disposed and configured to heat the liquid.

14. A filling system for an unpressurized filling of a liquid product in bottles or similar containers (2), said filling system having at least one filler element (3) with a product chamber or liquid channel (8), which is formed in a filler element housing (7), is connected to a reservoir (6) for the liquid product and forms a liquid product dispenser (11), by way of which the liquid product flows into the respective container (2) to be filled, a liquid valve (10) that is positioned at the liquid channel (8), a return gas channel (13, 14) which during the filling process is connected to the interior space of the container (2) that is arranged in a sealing position against the filler element (3), and a first flow path (16), which is realized in the filler element housing (7), is connected to the return gas channel (13, 14) and is switchable for slow filling into a throttled state in a manner controlled by valves to discharge the gas or air quantity displaced by the liquid product out of the interior space of said container during the filling of a container (2), wherein the first flow path (16) has a single control valve (17), which is provided in at least one first channel section (15.1, 15.2) of the first flow path (16) that is connected to the return gas channel (13, 14) for the controlled opening and closing of said channel section, and in that the first flow path has at least one additional throttled channel section (20) that bridges the control valve (17).

15. The filling system according to claim 14, wherein said first controlled flow path (16) is provided between the return gas channel (13, 14) and a first collecting chamber (18) that is common to a plurality of filler elements (3).

16. The filling system according to claim 15, wherein in said reservoir (6) there is a liquid space (6.2) for the liquid product and located above said liquid space (6.2) a gas space (6.1), and in that the gas space (6.1) of the reservoir (6) is connected to the first flow path (16) or to the first collecting chamber (18).

17. The filling system according to claim 16, wherein said return gas channel is formed partially by a gas space (14) in the filler element housing (7), to which the first flow path is connected.

18. The filling system according to claim 17, wherein, by means of the at least one second throttled channel section (20), there is a constant connection between the return gas channel (13, 14) or the gas space (14) of said return gas channel and the gas space (6.1) of the reservoir or of the first collecting chamber (18).

19. The filling system according to claim 18, wherein said return gas channel is formed by a return gas pipe (13) which is open at both ends and extends into the interior space of the container (2) to be filled with its bottom end and into the gas space (14) with its top end.

20. The filling system according to claim 19 further comprising one of a)-h):

a) a second flow path (21) is realized in the filler element housing (7) for heating or keeping hot the respective filler element (3) during a hot filling process, said second flow path, with reference to the flow direction of the liquid product in the liquid channel (8), connecting to a part section (8.1) of the liquid channel (8) located upstream of the liquid valve (10), and in that at least one control valve (25) is provided for controlling the flow of a hot liquid product from the reservoir (6) through the part section (8.1) and the second flow path (21);

b) a second flow path (21) is realized in the filler element housing (7) for heating or keeping hot the respective filler element (3) during a hot filling process, said second flow path, with reference to the flow direction of the liquid product in the liquid channel (8), connecting to a part section (8.1) of the liquid channel (8) located upstream of the liquid valve (10), and in that at least one control valve (25) is provided for controlling the flow of a hot liquid product from the reservoir (6) through the part section (8.1) and the second flow path (21), the second flow path connects the part section (8.1) of the liquid channel (8) of the respective filler element (3) to a second collecting chamber (22) that is common to a plurality of filler elements (3);

c) a second flow path (21) is realized in the filler element housing (7) for heating or keeping hot the respective filler element (3) during a hot filling process, said second flow path, with reference to the flow direction of the liquid product in the liquid channel (8), connecting to a part section (8.1) of the liquid channel (8) located upstream of the liquid valve (10), and in that at least one control valve (25) is provided for controlling the flow of a hot liquid product from the reservoir (6) through the part section (8.1) and the second flow path (21), the second flow path connects the part section (8.1) of the liquid channel (8) of the respective filler element (3) to a second collecting chamber (22) that is common to a plurality of filler elements (3), the at least one second control valve (25) is provided in the second flow path (21);

d) a second flow path (21) is realized in the filler element housing (7) for heating or keeping hot the respective filler element (3) during a hot filling process, said second flow path, with reference to the flow direction of the liquid product in the liquid channel (8), connecting to a part section (8.1) of the liquid channel (8) located upstream of the liquid valve (10), and in that at least one control valve (25) is provided for controlling the flow of a hot liquid product from the reservoir (6) through the part section (8.1) and the second flow path (21), the second flow path connects the part section (8.1) of the liquid channel (8) of the respective filler element (3) to a second collecting chamber (22) that is common to a plurality of filler elements (3), the at least one second control valve (25) is provided in the second flow path (21), the at least one second control valve (25) is provided in a connection for discharging the hot liquid product out of the second flow path (21), for example in a line (24) connected to the second collecting chamber (22) for discharging, for example for returning the liquid product to the reservoir (6);

e) a second flow path (21) is realized in the filler element housing (7) for heating or keeping hot the respective filler element (3) during a hot filling process, said second flow path, with reference to the flow direction of the liquid product in the liquid channel (8), connecting to a part section (8.1) of the liquid channel (8) located upstream of the liquid valve (10), and in that at least one control valve (25) is provided for controlling the flow of a hot liquid product from the reservoir (6) through the part section (8.1) and the second flow path (21), the second flow path connects the part section (8.1) of the liquid channel (8) of the respective filler element (3) to a second collecting chamber (22) that is common to a plurality of filler elements (3), the at least one second control valve (25) is provided in the second flow path (21), the at least one second control valve (25) is provided in a connection for discharging the hot liquid product out of the second flow path (21), for example in a line (24) connected to the second collecting chamber (22) for discharging, for example for returning the liquid product to the reservoir (6), in a filling machine with a plurality of filler elements (3), the second control valve (25) is either provided jointly for all the filler elements (3) of the filling machine or for a group of several filler elements (3);

f) a second flow path (21) is realized in the filler element housing (7) for heating or keeping hot the respective filler element (3) during a hot filling process, said second flow path, with reference to the flow direction of the liquid product in the liquid channel (8), connecting to a part section (8.1) of the liquid channel (8) located upstream of the liquid valve (10), and in that at least one control valve (25) is provided for controlling the flow of a hot liquid product from the reservoir (6) through the part section (8.1) and the second flow path (21), the second flow path connects the part section (8.1) of the liquid channel (8) of the respective filler element (3) to a second collecting chamber (22) that is common to a plurality of filler elements (3), the at least one second control valve (25) is provided in the second flow path (21), the at least one second control valve (25) is provided in a connection for discharging the hot liquid product out of the second flow path (21), for example in a line (24) connected to the second collecting chamber (22) for discharging, for example for returning the liquid product to the reservoir (6), in a filling machine with a plurality of filler elements (3), the second control valve (25) is either provided jointly for all the filler elements (3) of the filling machine or for a group of several filler elements (3), a non-return valve (23) is provided in the second flow path (21), said non-return valve opening for a flow out of the liquid duct (8) of the filler element (3) and closing for a flow in the opposite direction;

g) a second flow path (21) is realized in the filler element housing (7) for heating or keeping hot the respective filler element (3) during a hot filling process, said second flow path, with reference to the flow direction of the liquid product in the liquid channel (8), connecting to a part section (8.1) of the liquid channel (8) located upstream of the liquid valve (10), and in that at least one control valve (25) is provided for controlling the flow of a hot liquid product from the reservoir (6) through the part section (8.1) and the second flow path (21), the second flow path connects the part section (8.1) of the liquid channel (8) of the respective filler element (3) to a second collecting chamber (22) that is common to a plurality of filler elements (3), the at least one second control valve (25) is provided in the second flow path (21), the at least one second control valve (25) is provided in a connection for discharging the hot liquid product out of the second flow path (21), for example in a line (24) connected to the second collecting chamber (22) for discharging, for example for returning the liquid product to the reservoir (6), in a filling machine with a plurality of filler elements (3), the second control valve (25) is either provided jointly for all the filler elements (3) of the filling machine or for a group of several filler elements (3), a non-return valve (23) is provided in the second flow path (21), said non-return valve opening for a flow out of the liquid duct (8) of the filler element (3) and closing for a flow in the opposite direction, the second flow path (21) opens out into the liquid channel (8) in the direct vicinity of the liquid valve (10) or of a valve seat (10.2) of the liquid valve (10);

h) a second flow path (21) is realized in the filler element housing (7) for heating or keeping hot the respective filler element (3) during a hot filling process, said second flow path, with reference to the flow direction of the liquid product in the liquid channel (8), connecting to a part section (8.1) of the liquid channel (8) located upstream of the liquid valve (10), and in that at least one control valve (25) is provided for controlling the flow of a hot liquid product from the reservoir (6) through the part section (8.1) and the second flow path (21), the second flow path connects the part section (8.1) of the liquid channel (8) of the respective filler element (3) to a second collecting chamber (22) that is common to a plurality of filler elements (3), the at least one second control valve (25) is provided in the second flow path (21), the at least one second control valve (25) is provided in a connection for discharging the hot liquid product out of the second flow path (21), for example in a line (24) connected to the second collecting chamber (22) for discharging, for example for returning the liquid product to the reservoir (6), in a filling machine with a plurality of filler elements (3), the second control valve (25) is either provided jointly for all the filler elements (3) of the filling machine or for a group of several filler elements (3), a non-return valve (23) is provided in the second flow path (21), said non-return valve opening for a flow out of the liquid duct (8) of the filler element (3) and closing for a flow in the opposite direction, the second flow path (21) opens out into the liquid channel (8) in the direct vicinity of the liquid valve (10) or of a valve seat (10.2) of the liquid valve (10), the first and/or second collecting chamber (18, 22) are provided on the rotor.

* * * * *